US006489549B2

(12) United States Patent
Schmitz et al.

(10) Patent No.: US 6,489,549 B2
(45) Date of Patent: Dec. 3, 2002

(54) ELECTRONIC DEVICE WITH MULTIPLE SEQUENCES AND METHODS TO SYNCHRONIZE THEM

(75) Inventors: Jurgen Schmitz, Ancona (IT); Francesco Castagna, Recanati (IT); Paolo Galassi, Castelfidardo (IT)

(73) Assignee: Korg Italy-S.p.A., Osimo (IT)

( * ) Notice: Subject to any disclaimer, the term of this patent is extended or adjusted under 35 U.S.C. 154(b) by 0 days.

(21) Appl. No.: 09/898,177

(22) Filed: Jul. 3, 2001

(65) Prior Publication Data

US 2002/0002898 A1 Jan. 10, 2002

(30) Foreign Application Priority Data

Jul. 7, 2000 (IT) ..... AN00A0026

(51) Int. Cl.[7] ..... G10H 1/42

(52) U.S. Cl. ..... 84/609; 84/612; 84/645; 84/649; 84/652; 84/DIG. 12

(58) Field of Search ..... 84/611, 612, 635, 84/636, 645, 651, 652, 667, 668, 615–620, 653–658, 115, DIG. 12, 609, 610, 634, 649, 650, 666

(56) References Cited

U.S. PATENT DOCUMENTS 4,320,683 A * 3/1982 Whitefield ..... 84/115
4,412,470 A * 11/1983 Jones ..... 84/645
4,889,026 A * 12/1989 Abe ..... 84/DIG. 12

* cited by examiner

*Primary Examiner*—Stanley J. Witkowski
(74) *Attorney, Agent, or Firm*—Armstrong, Westerman & Hattori, LLP

(57) ABSTRACT

The present invention relates to an electronic device composed of two or more conventional sequencers of conventional type that implement elaborate timed sequences of events, such as musical songs in MIDI format or in an equivalent digital proprietary format. The sequencers are associated to control and manage electronics that allow them to work in either an independent or co-ordinated way.

22 Claims, 9 Drawing Sheets

OPERATOR PANEL

Positioning start synch method
SEQ1 and SEQ2 have same time signature (4/4)

Positioning start synch method
SEQ1 and SEQ2 have *different* time signature 4/4 and 3/4

Tempo lock and delayed synch start on Measure between two sequencers elaborating 2 songs with different tempo
In this case songs have same time signature (4/4)

Tempo lock and delayed synch start on Beat between two sequencers elaborating 2 songs with different tempo
In this case songs have same time signature (4/4)

Operator changes BPM when sequencers are in tempo lock

Bar lock synchronisation
between two sequencers
In this case songs have different time signature
song1 = 4/4 song2=3/4

Simultaneous start, Tempo lock and Positioning start synch methods on two sequencers with same time signature 4/4

ELECTRONIC DEVICE WITH MULTIPLE SEQUENCES AND METHODS TO SYNCHRONIZE THEM

The present invention relates to an electronic device provided with multiple sequencers capable of independent or coordinated operation.

In particular, reference is made to the type of sequencers used in electronic musical instruments, such as electronic organs, electronic pianos, synthesisers, electronic keyboards or similar devices.

Conventionally, a sequencer for recording/playing sequences of time stamped events on/from a recording medium is integrally or separately provided to an electronic musical instrument, such as an electronic organ. A sequencer serves all the tasks that generate sequences of timed events. In this context, sequences of timed events include, but are not limited to, songs in MIDI or digital proprietary format.

Typically, a sequencer has a record (RECORD) function, a play (PLAY) function, a fast-forward (F.F. >>) function, a rewind (REW. <<) function, a stop (STOP) function, a repeat (REPEAT) function, a positioning function (SEEK) and a PAUSE function, and other similar functions, and it is provided with a plurality of operation buttons to control these functions.

The sequencer is also provided with a plurality of switches, knobs, and buttons, typically arranged on a control panel, that allow for setting sound control information to control the tone colour, tone volume, effects and other characters to be generated. The sequencer typically stores the sound control information and simultaneously and instantaneously reproduces the state of the panel controls upon operation.

The data source for the sequencers may be external (i.e. from a MIDI connection or a remote communications network server computer) or internal (in this case data is stored in Flash ROM, RAM, Floppy Disk, Hard Disk, CD-ROM, magneto-optical disk, Digital Versatile Disk or other storage device). It is a common need of musicians to have the possibility to select the next song/music pattern to be played while playing the current song/pattern, to start the next song at a specific measure when ending play the current song/pattern and fade in/out between two songs or music patterns.

In other terms, there is the need for the musician to use an electronic musical instrument like a DJ (Disc Jockey) uses two or more record players (turn tables) to carry out continuous reproduction or remix of music. The DJ sets two records in the record players and performs reproduction while manually operating on record players, setting the pick up of one turn table on a specific track, and pre- listens to it on headphones while playing the other record, performing mixing between the two records, at specific time fading in/out between the two, while manually changing the rotating speed of the turn tables, thus adjusting the beat (tempo) of the two records being played to his feeling.

The use of a single conventional sequencer does not satisfy any of the aforementioned requirements. This need is furthermore remarked by the fact that solutions exist on the market giving the possibility to pre-listen to the next song/pattern to be played on a single sequencer through software artifacts. It would be hence desirable to have a system with two or more sequencers to implement the above demanded features in electronic musical instruments.

BRIEF SUMMARY OF THE INVENTION

An object of the present invention is to provide an electronic musical instrument with two, or more, sequencers with means to control, mix and synchronise them.

Accordingly, this invention includes common panel control means (switches, knobs, buttons, combinations of these) used to set various kinds of sequence control information elaborated on the two sequencers (for example to set the songs tempo and/or synch information for each sequencer), duplicated sets of panel operation controls, a specific set for each sequencer implemented in the machine, to simultaneously and independently control sequencers operations (switches, knobs, buttons and/or combinations of these that include functions to start, stop, pause, forward, rewind, and position each of the sequencers).

The sequences also include panel control means for mixing (function of balancing, i.e. fading in/out between the sequencers) and synchronising time stamped events elaborated in the sequencers. In addition, displaying means (LCD or similar device) is included in order to monitor the activity and instant setting of the sequencers.

This invention will be described in further details by way of an example with reference to the accompanying drawings. One embodiment of the invention consists in two music sequencers, as above described, operating on sequences of timed events that in this context are songs in MIDI or digital proprietary format, which simultaneously generate music performances on a tone generator. The operator uses local or remote operating controls to set, operate and possibly synchronise the sequencers.

This embodiment also includes the methods to synchronise the two sequencers. It must be noted that the synch methods described in the hereinafter embodiment also apply in case that more than two sequencers are present in the machine.

BRIEF DESCRIPTION OF THE DRAWINGS

For the major clarity the description of the invention continues with reference to the enclosed drawings, which are intended for purposes of illustration and not in a limiting sense, whereby.

DETAILED DESCRIPTION OF THE INVENTION

Figure 1:
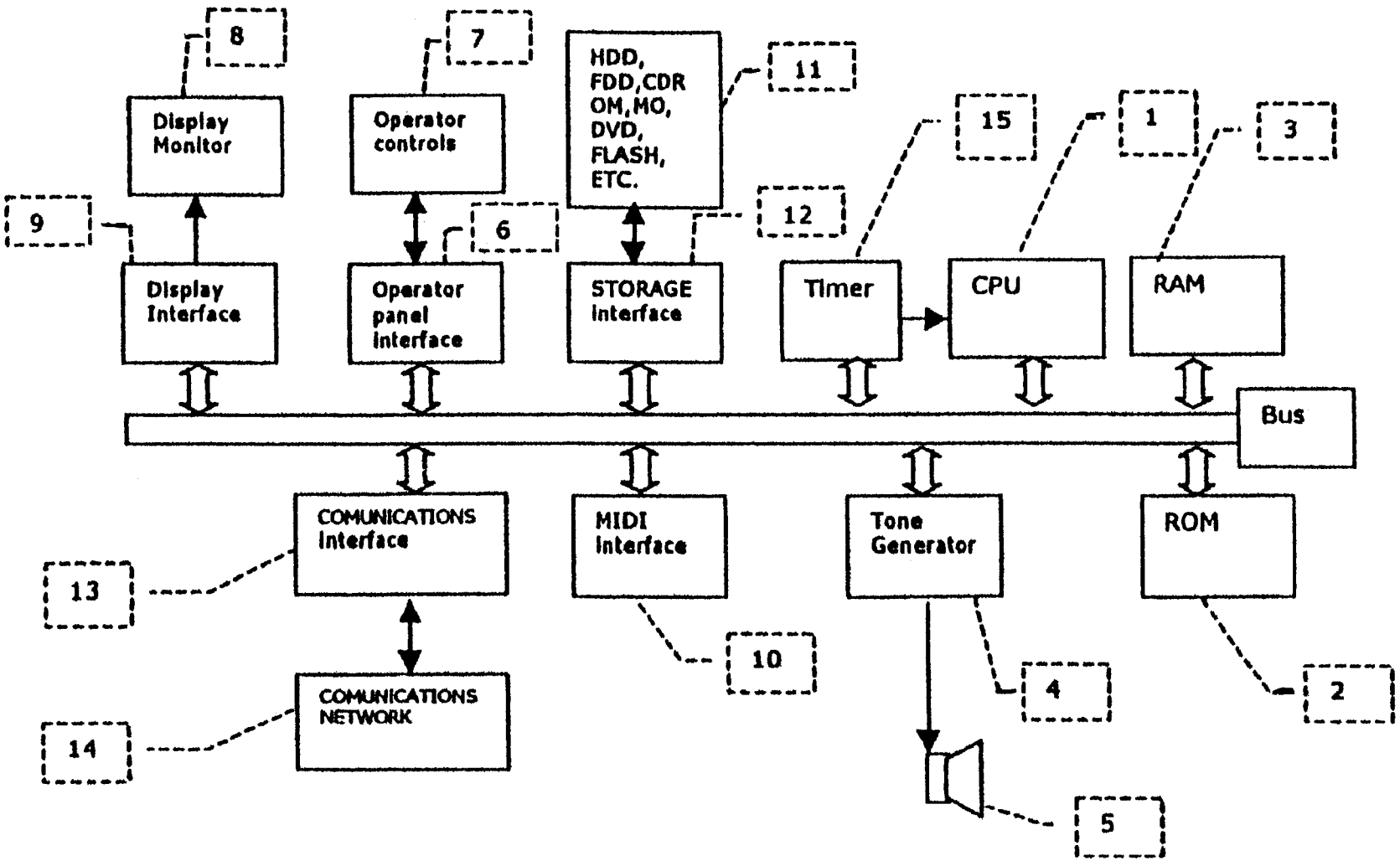
FIG. 1 is a block diagram showing the overall arrangement of an electronic musical instrument comprising the sequencers according to above described embodiment of the present invention.

In particular, FIG. 1 shows a block diagram that illustrates a typical hardware to which the present invention is applied.

In the figure, a CPU 1 (central processing unit) controls the entire system by means of a control program stored in a ROM 2 using a RAM 3 as work area. The RAM 3 stores song data, music pattern data, arrangement pattern data, and so on. The RAM 3 has a buffer for storing variables for each track of data to be sequenced by each of the sequencer implemented in the instrument.

As described in the previous section, in the present embodiment, the data pattern is constituted by timed events referred as songs in MIDI or digital proprietary format. In addition, the music data is composed of plural tracks corresponding to plural parts of the data being sequenced.

Timing is provided by a timer 15 to sequentially process songs/music data pattern.

The sequenced data pattern is sent to a tone generator circuit 4. The tone generator circuit 4 can generate a plurality of sounds through plural channels at a time. Each sound has a predetermined timbre set in a corresponding music pattern data track. The tone generator circuit 4 generates the sounds characterised by the pitch, note-on, and velocity set by the CPU 1. The resultant sound signal is sounded by a sound system 5.

The aforementioned procedure is executed simultaneously by each of the two sequencers instanced in the present embodiment. This means that each sequencer elaborates its own sequence data pattern, and may or may not interact with the other sequences of the instruments, as later described in this document.

Both sequenced data pattern may be sent to tone generator 4 for sound synthesis and then to sound system 5 for sound generation. It must be clear that sending sequenced data to a tone generator 4 is only a possible embodiment of the invention, alternatively both or only one of the sequenced data pattern, for example, could be stored in a storage device like RAM, FD, HD, FLASH ROM or similar.

The two sequencers are operated and managed by various switches disposed on an operator panel or by remote commands as described hereafter. The CPU 1 captures input commands from the various switches of the operator controls 7 via a detector circuit 6 and executes processing accordingly.

A monitor display 8 is arranged on the operator panel and is made up of a liquid crystal panel, for example. The CPU 1 outputs graphic data to a display interface 9 and a monitor display 8 visually indicates the data.

A storage device 11 may be composed of a hard disk drive (HDD), a floppy disk drive (FDD), a CD-ROM drive, a magneto-optical disk drive (MO), or a digital versatile disk drive (DVD), and may be used through storage interface 12 to store or input songs or music data pattern for automatic performance sequencing.

Alternatively, a MIDI interface (I/F) 10 may be used to transfer pattern data and song data to/from an externally attached MIDI device. A communications interface 13 is connected to a communications network 14 to receive various data, such as, for example, sequences of data pattern from a server computer.

Figure 2:
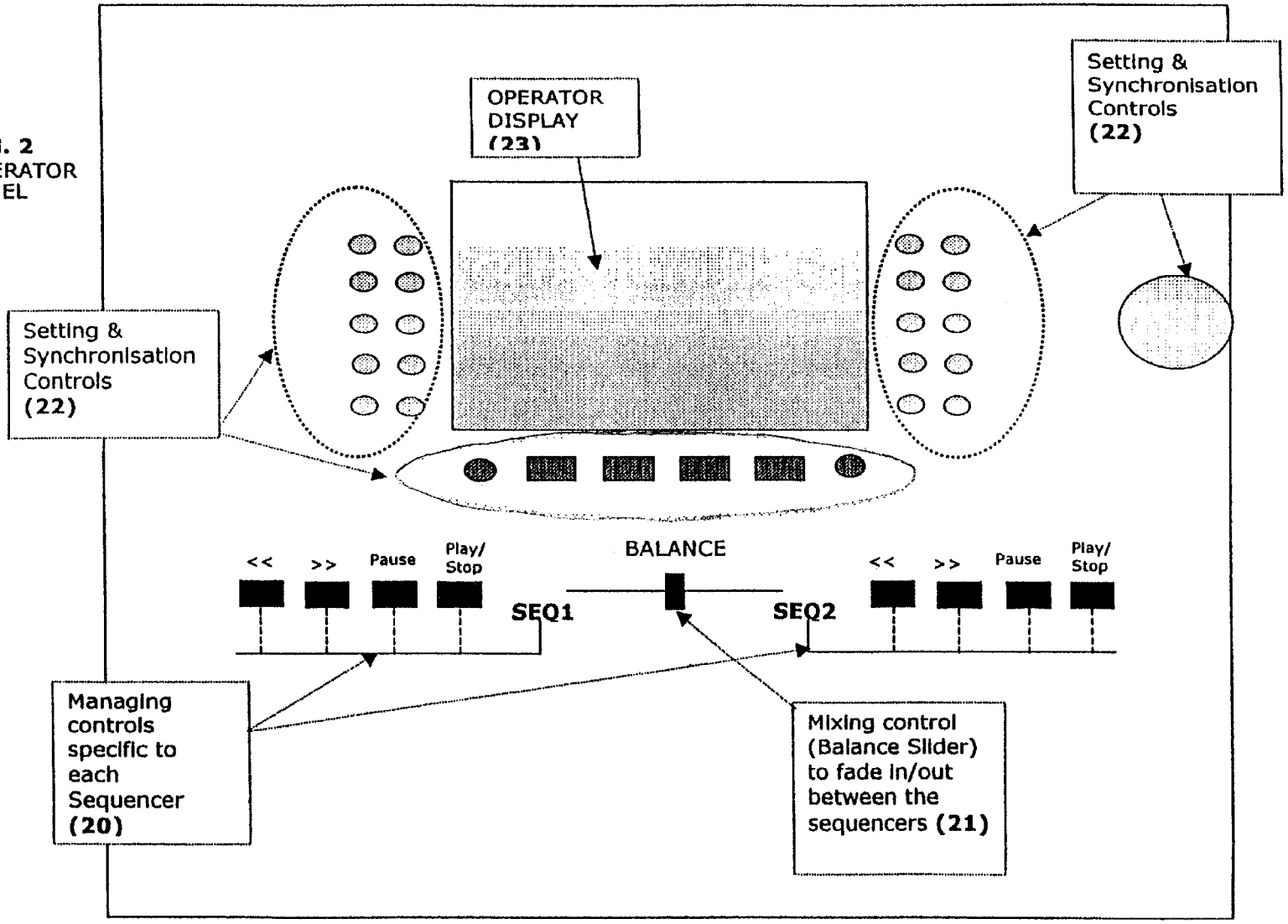
FIG. 2 is a diagram showing a possible arrangement of the operator panel for the present embodiment of the invention. It shows a possible arrangement of a double set of panel managing control means 20 (a specific set for each sequencer), a mixing control mean 21 (a slider knob in this drawing) to fade in/out the 2 sequencers and switching buttons 22 used to set and synch sequencers parameters. Parameter settings for the sequencers are displayed on an operator display 23.

The operator controls may be classified, depending on the function to be accomplished on sequencers. FIG. 2 illustrates an example of arrangement of the operator panel.

There are basically three classes of operating modes available for the operator:

1. Setting functions
2. Managing functions
3. Synchronisation functions

Through the setting functions the operator sets various sequencing parameters, such as the song to be performed, tempo, pitch and others, and assigns these parameters to each sequencer. The setting is done by the operator acting on local operator controls 7 (knobs, switches, buttons, keyboard keys, or combinations of these) or remote controls (for example commands issued through MIDI interface 10 or from communication network 14 through communication interface 13).

The settings for both sequencers are displayed on a monitor display 8.

In managing functions, independent sets of managing controls are available for the operator to start, stop, position (seek function), forward, rewind, pause, simultaneously and independently the two sequencers. In particular, the invention also includes control means for each sequencer, in order to actuate and control each sequencer in an independent, simultaneous way. FIG. 2 shows an example of this, with a set of control means 20 for each sequencer. Managing functions include the mixing function between the two sequencers. In this case the operator uses a control means 21 (a slider knob in FIG. 2) to mix (balance) between the two sequencers, fading in/out between the two.

In another aspect of the invention a single set of managing controls may be provided; the operator uses combinations of this single set of managing controls to carry out the same operations as above.

Synchronisation functions provide synchronisation between the two sequencers. Synchronisation parameters, like tempo and others, are set by the operator acting on local (operator panel) or remote (as commands issued through MIDI interface 10 or from communication network 14 through communication interface 13) synchronisation controls (knobs, switches, buttons, keyboard keys, combination of these or others).

As described above, with reference to FIG. 2, the operator applies setting functions operating on setting controls 22 to set various parameters for each sequencer. The current settings of the sequencers are displayed on a monitor display 23. The operator also applies managing functions operating on managing controls 20, specific to each sequencer, to start, stop, pause and position each sequencer to a desired point, and also uses mix controls 21 to mix between the sequencers. In addition, the operator may use synchronisation functions 22 to establish interaction between the two sequencers.

The methods used to establish interaction between the sequencers are another aspect of present invention and hereafter described in details.

In the present invention, sequencers may interact or may not interact at all. The fact that they do not interact means that the settings and the working method of each sequencer, although simultaneous, are completely independent from the settings and the working method of the other sequencer. That is, parameters like tempo, song, pitch and others may completely differ between the two sequencers. The operator may apply setting and managing functions (as described above) to set parameters and operate on a sequencer, while the other sequencer is playing a song. Operating on a sequencer implies, for example, the possibility to select a song and load it from a storage media, like Floppy Disk, CD-ROM, from the network or from a MIDI interface, pre-listen to it in headphones, using managing functions 20 to position to a specific point of the song and using control means 20 and the balancing slider 21, respectively, to activate the sequence and balance between the song in pre-listening mode and the song being reproduced. In this case the sequencers are completely disjoint, that means each of them elaborates simultaneously its own sequence of timed events with tempo and other parameters completely disjoint from those of the other sequencer.

The operator uses managing functions specific to each sequencer to control the relative sequencer, and mixing functions to balance between the two. In another aspect of this invention, setting may be done by an operator in the way to establish an interaction between the two sequencers.

The fact that the two sequencers interact means that a relationship is established between some of their parameters.

The nature of this relationship may be static, dynamic or both. Static relationship means a property set by the operator that makes use of some parameter from a sequencer and others parameters from the other sequencer. As an example, the possibility for an operator to select a song (song A) and assign it to sequencer 1, select another song (song B) and assign it to sequencer 2, and considering that each song is constituted by multiple tracks, the static relationship may consist in the possibility of selecting for playing a subset of tracks made up by some tracks of song A and some tracks of song B.

A dynamic relationship may be a time synchronisation between some parameters of the two sequencers.

The parameters synchronisation include the following synchronisation methods:

Tempo lock synch

Bar lock synch

Delayed start synch

Positioning start synch

Simultaneous start synch.

In tempo lock synch tempo synchronisation, procedures are established in order to adjust tempo parameter between sequencers.

The typical measure of tempo in a sequencer is BPM (Beats Per Minute). Timed events to be processed by a sequencer typically contain a tempo information for the sequencer. The term tempo lock synchronisation indicates a procedure to adjust the tempo (lock of tempo) of sequenced data on a sequencer to the tempo of sequenced data on the other sequencer: that is, a procedure to establish the same BPM for the two sequencers.

Methods to establish the same BPM include:

Possibility for the operator to define a tempo to which the sequencers have to lock.

Possibility for the operator to define an automatic time locking procedure for the sequencers.

For instance, if a sequencer is active when the other is started, the latest started sequencer locks to the tempo of the one already active. Alternatively, an active sequencer tempo could be locked to the tempo of a latest started sequencer. If more than one sequencer is present, a procedure could be established to determine a tempo locking method for the sequencers. For example, if two sequencers are already active with different tempo and a third sequencer is started, the operator may decide through synchronisation means to which tempo the new sequencer tempo should lock. Alternatively, a procedure may be activated to automatically assign tempo to newly started sequencers. It must be noted that when sequencers are in tempo lock, if tempo is changed by the operator acting on panel controls or by commands issued remotely for example through a MIDI interface or network communication interface, the tempo of all sequencers that are in tempo lock will be changed accordingly.

In Bar lock synch method, the term synchronisation indicates a procedure to adjust the BPMs of the sequencers that elaborate songs or music patterns with different time signature (for example 4/4 and 3/4), so to have the same measure duration for both sequencers.

In Delayed start synch method synchronisation between sequencers may be accomplished by:

Synch on measure

Synch on beat

In synch on measure the start of new sequencer (i.e. the data sequencing for that sequencer) will be delayed as much as to exactly coincide with the start (first beat of the measure) of next measure of active sequencer, when the new sequencer is activated. Alternatively, the measure to which the start will be synchronised may be specified by the operator with synchronisation controls (keys, knobs or others) or automatically retrieved by a synchronisation procedure activated when starting a sequencer. Moreover, a new started sequencer may point (in terms of measure and beat pointed at that moment) everywhere in the data to be sequenced at time sequencer is started.

Likewise, in synch on beat, the start of new sequencer (i.e. the data sequencing for that sequencer) will be delayed as much as to exactly coincide with the next beat of active sequencer, when the new sequencer is activated. Alternatively, the beat to which the start will be synchronised may be specified by the operator with synchronisation controls or automatically retrieved by a synchronisation procedure activated when starting a sequencer. Moreover, the locator (measure and beat referred by sequencer) of new started sequencer may be positioned everywhere in the data to be sequenced at time sequencer is started.

The start of a sequencer at the end of another sequencer should be considered as a special case of synch on a specific measure. In this case, the start of an inactive sequencer is synch to the last measure of an active sequencer. This means that the active sequencer plays the last beat of the last measure, while the new sequencer starts playing a song exactly on the beat it had happen if the ending sequencer had continued playing a new measure.

In an alternative method to accomplish synchronisation, referred as Positioning start synch, the start of sequencer is not delayed; synchronisation is accomplished by positioning the starting sequencer at exactly the same position of active sequencer, in terms of beat position in the measure located by starting sequencer, and then started.

Figure 3A:
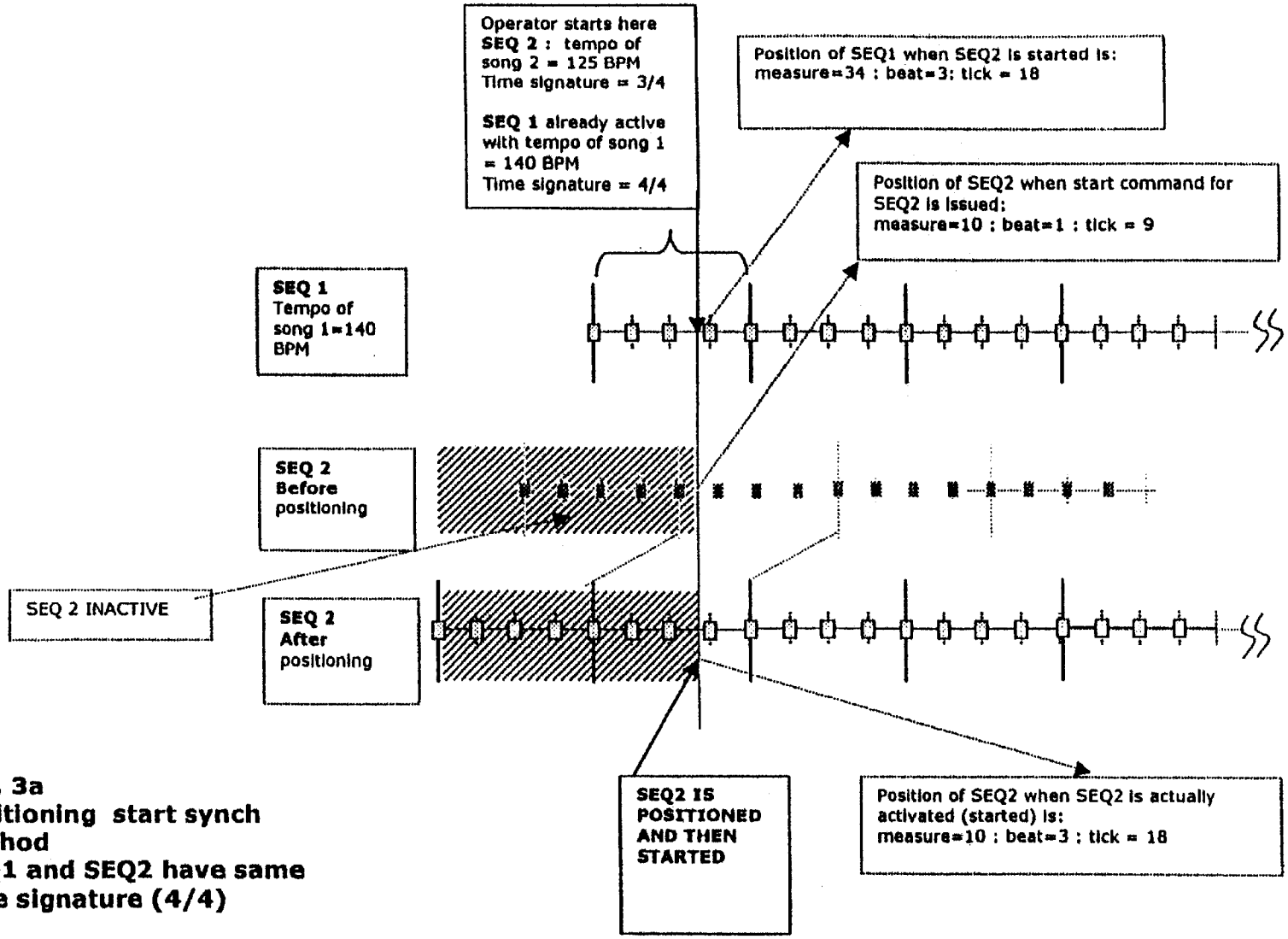
FIGS. 3*a*, 3*b*, 4*a*, 4*b*, 4*c*, 5 and 6 are examples of the synch methods used to synchronise the two sequencers.
Figure 3B:
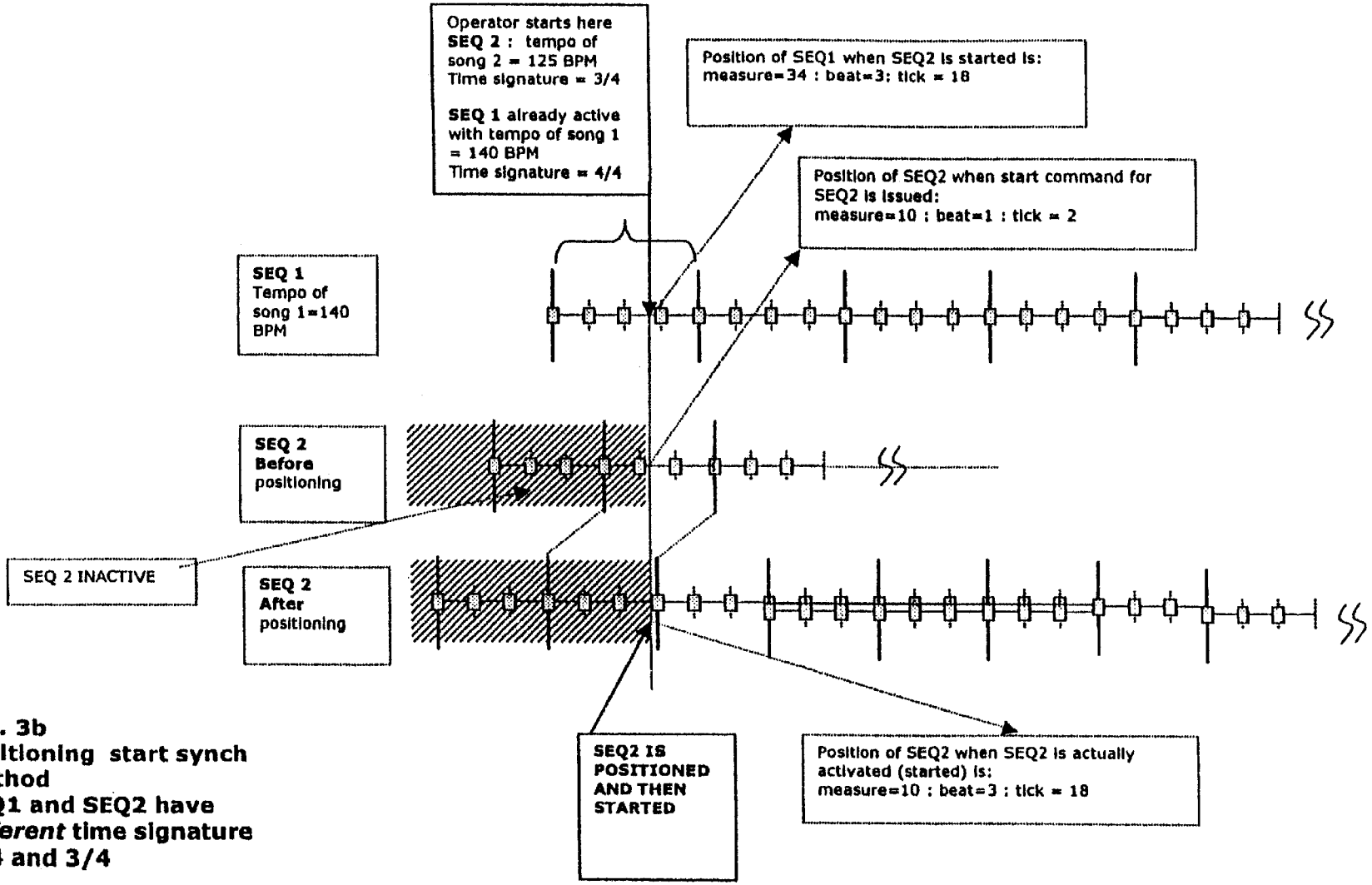

For a better explanation of this synch method, refer to FIGS. 3*a* and 3*b*. In these figures, the relative positions of two sequencers, with different tempo and same/different (FIG. 3*a*/FIG. 3*b*) time signature, are shown at time when start command for SEQ 2 is issued, and when SEQ 2 is actually started. Alternatively, synchronisation may be accomplished by positioning the starting sequencer at exactly the same position of active sequencer, in terms of beat position in a measure, that may be specified by the operator with synchronisation controls, or automatically retrieved by a synchronisation procedure activated when starting a sequencer. In both cases of positioning synch start explained above, the locator of new started sequencer may be positioned everywhere in the data to be sequenced at time sequencer is started.

Another method of synchronisation includes the simultaneous start of the two sequencers with a unique command. In this case a unique command is issued by the operator with synchronising controls (as usual, keys, knobs, etc. or commands issued through a MIDI interface or network communication interface) to simultaneously start the two sequencers arbitrarily positioned on the songs. The word synchronous means that the same starting command is issued at exact the same instant to both sequencers.

The above-explained methods are part of this invention and apply individually. This means that each of the methods is self-standing in the sense that each applies independently from the application of the others. Moreover, the methods apply independently from the tempo and time signature of the two songs/music patterns. That means that tempo and time signature may be equal or different: synch methods still apply in both cases. In another aspect of this invention, each of the aforesaid methods may be applied in combination with one or more of the explained methods. Moreover, any combination of synch methods may be activated issuing a single command. In particular, this means that an operator may activate (through operator controls or with commands issued through a MIDI interface or through a network communication interface) a simultaneous start synch, a tempo lock synch and a bar lock synch, issuing a single command by using a single button on operator panel. In the same way, any combination of synch methods may be de-activated issuing a single command.

Figure 4A:
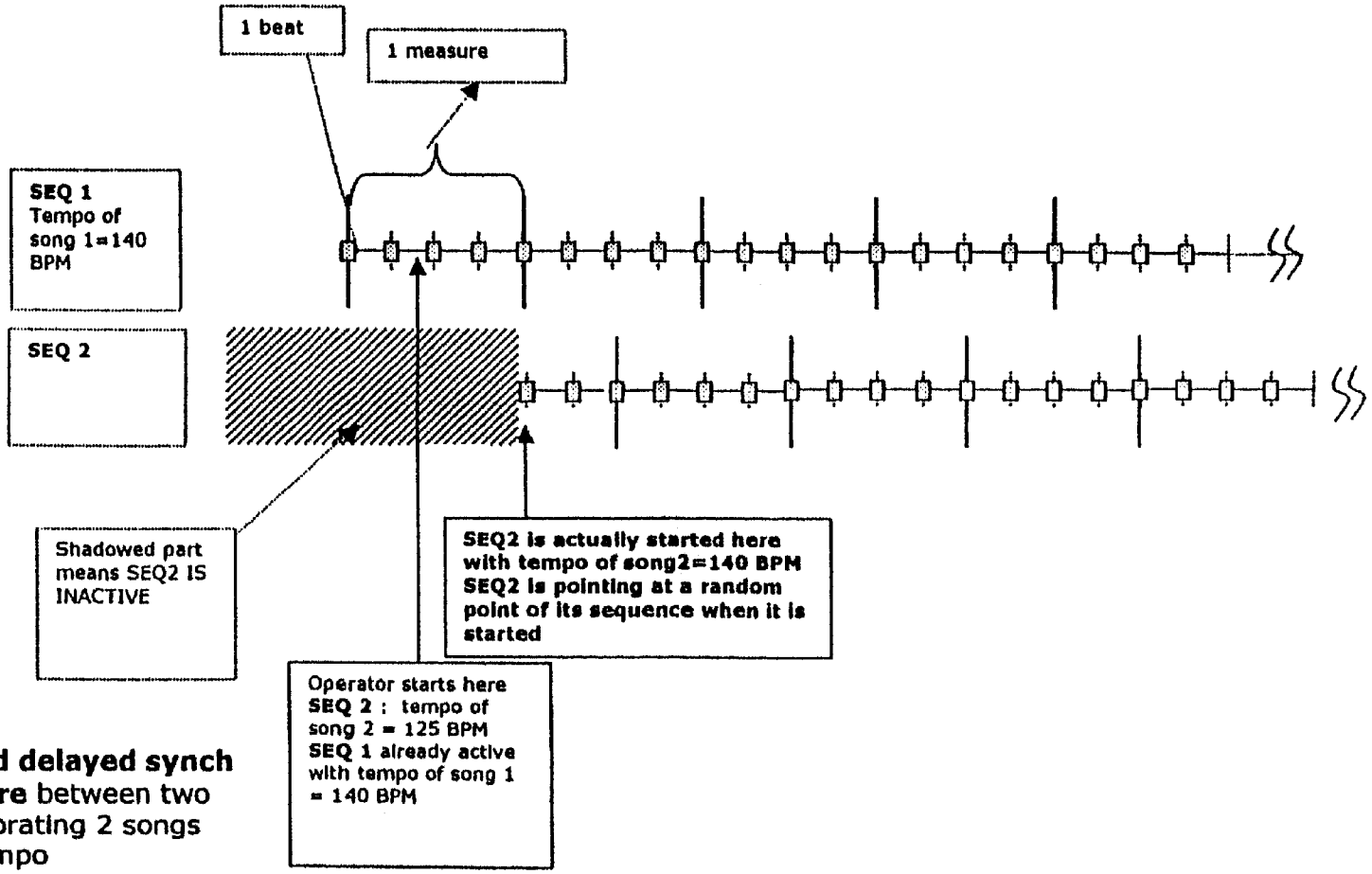
Figure 4B:
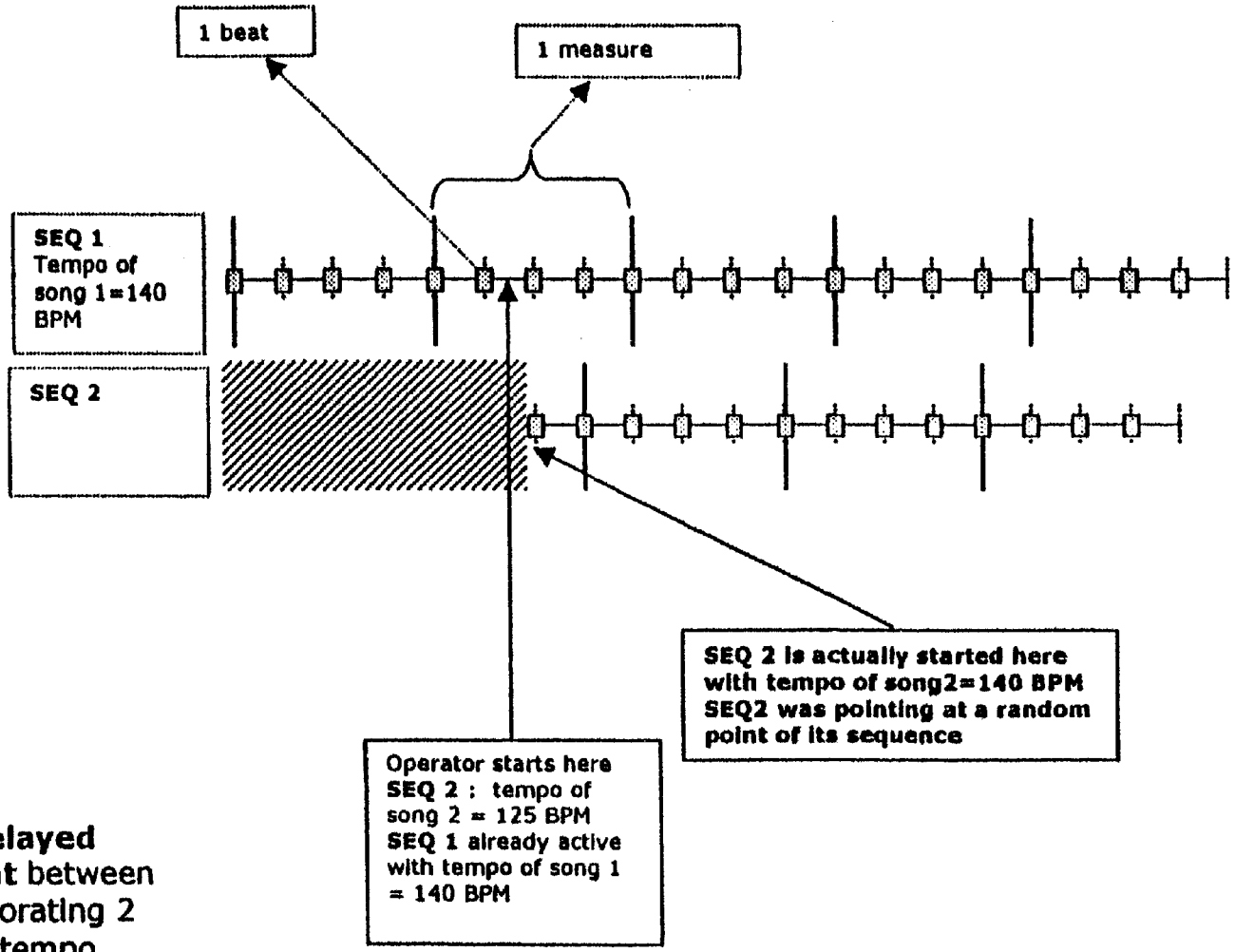

As an example, tempo lock method is applied in combination with delayed synch start methods in two cases: tempo lock and delayed synch on a measure (FIG. 4*a*) and tempo lock and delayed synch on a beat (FIG. 4*b*). It should be noted that while in FIG. 4*a* the combination of methods is applied to sequencers elaborating songs with different tempo, but same time signature, in FIG. 4*b* the combination of methods is applied to sequencers elaborating songs with different tempo and also different time signature.

Figure 4C:
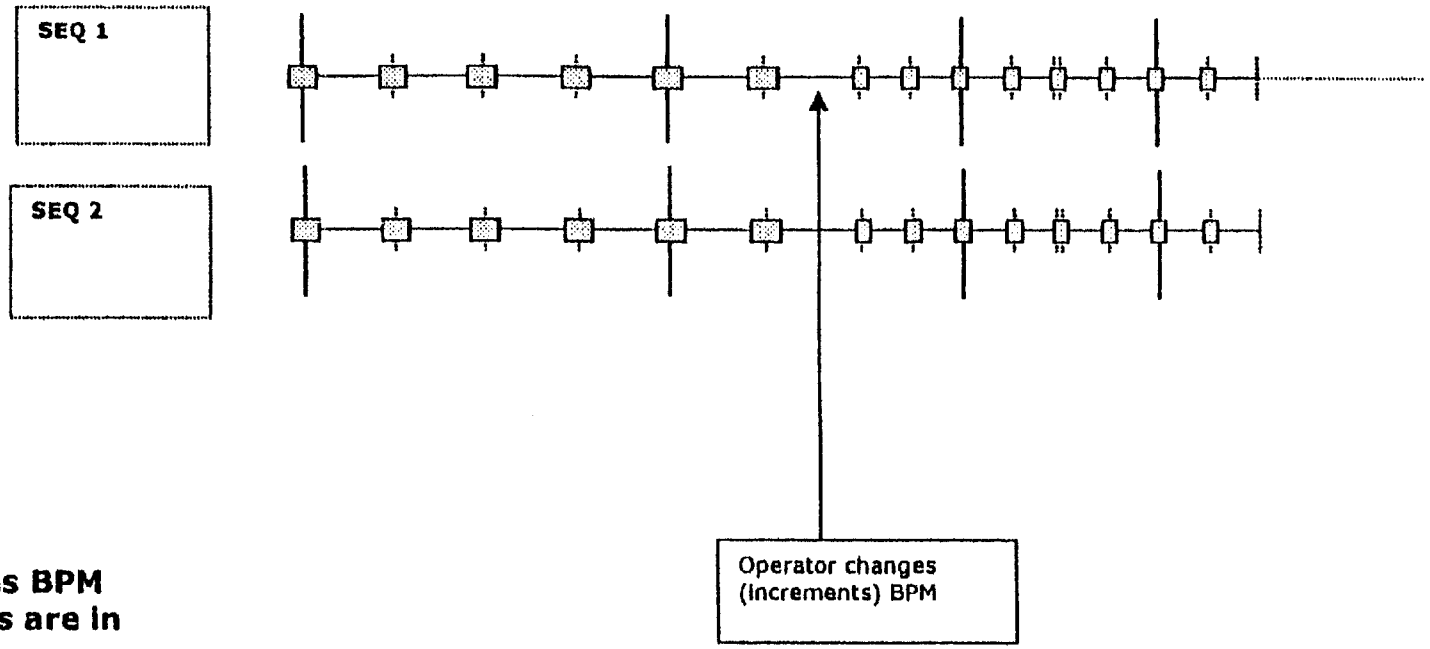

FIG. 4*c* shows what happens to two sequencers that are in tempo lock, if tempo is changed (BPM is increased in the example).

Figure 5:
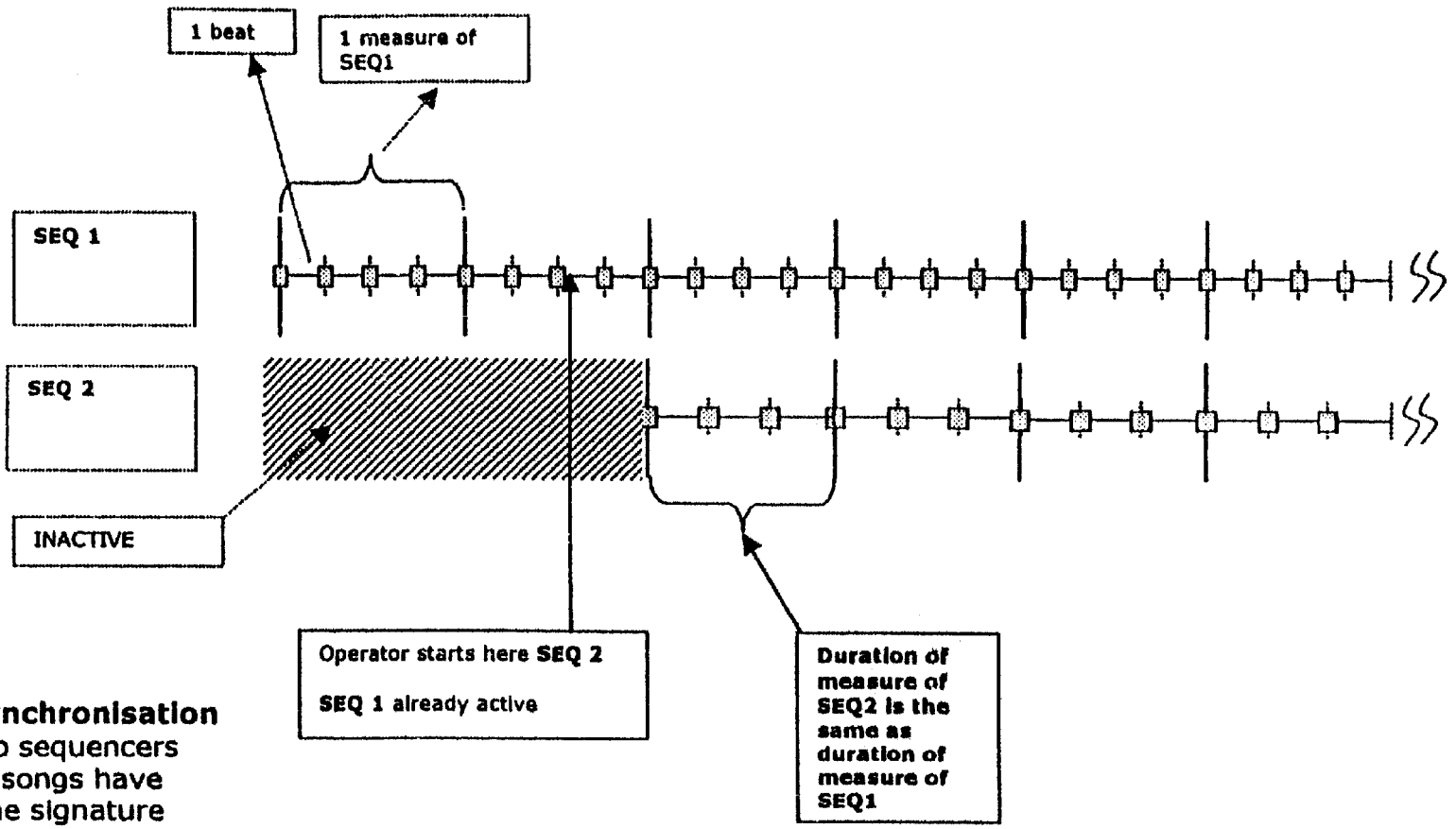

In the example of FIG. 5, the Dar lock synch method is applied to two sequencers elaborating songs with different time signature (time signature is 4/4 for SEQ 1, and 3/4 for SEQ 2).

Figure 6:
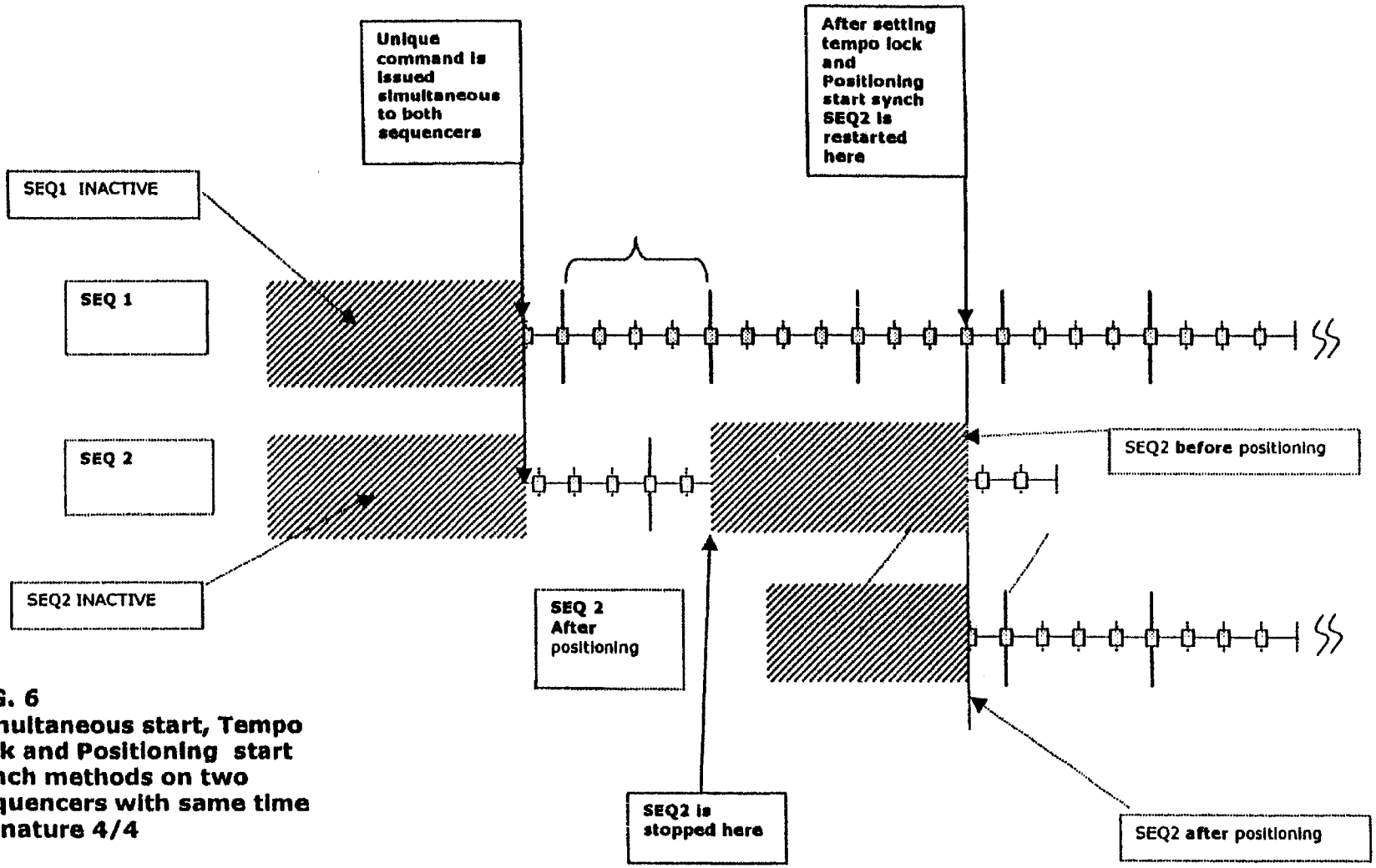

In FIG. 6 simultaneous start method is first applied to start the sequencers, and then a combination of tempo lock method and Positioning synch start method is applied.

In the above description, the use of two sequencers that elaborate songs or music patterns in MIDI or digital proprietary format from local or remote sources has been depicted in details and conducted as a typical example. In the above-mentioned embodiment, the use of songs and music pattern as sequencing data has also been described as an example. It will be apparent that the present invention extends to the use of N sequencers that elaborate sequences of timed events on electronic musical instruments.

It should also be remarked that sequences of timed events may be downloaded from a server computer through the communications interface. In this case, the sequencing apparatus is connected to a MIDI interface 10 or a communications network 14 such as a LAN (Local Area Network), the Internet, or a telephone line. The sequences of timed events are subscribed from a server computer and then stored on RAM 3, the hard disk or other storage device, from which may be retrieved by sequencers. Alternatively sequencers may be activated directly on downloading data, or a combination of these, i.e. some sequencing data may be locally other may be remotely provided.

The present invention is not limited to the tone-generator incorporated sequencers having the above-mentioned constitution. The present invention may also be applied to various electronic musical instruments of keyboard, string, wind, and percussion types. In addition, the present invention may be applied not only to electronic musical instruments incorporating a tone generator and automatic sequencing capability, but also to equipment in which a tone generator and sequencers are made of discrete devices interconnected by MIDI or communications means as described above.

What is claimed is:

1. An electronic device for controlling the generation of tones having at least two sequencers for playing sequences of time stamped events obtained from at least one source through at least one tone generator, comprising:

a first control controlling the operation of an associated first one of said at least two sequencers;

a second control controlling the operation of an associated second one of said at least two sequencers, said second control and said associated second one of said at least two sequencers operable simultaneously with and independently of said first control and said first one of said at least two sequencers;

a means cooperative with said first and second controls for selectively mixing a first sequence of time-stamped events from said first sequencer with a second sequence of time-stamped events from said second sequencer;

a means cooperative with said first and second controls for selectively synchronizing said first sequence of time-stamped events from said first sequencer with said second sequence of time-stamped events from said second sequencer.

2. The electronic device of claim 1, wherein said first control further comprises manual panel controls.

3. The electronic device of claim 1, wherein said first control further comprises an electronic command.

4. The electronic device of claim 1, wherein said tone generator is a musical instrument.

5. The electronic device of claim 3, further comprising a MIDI interface through which said electronic commands are passed prior to being executed by said first sequencer.

6. The electronic device of claim 3, further comprising a computer network through which said electronic commands are passed prior to being executed by said first sequencer.

7. An electronic musical instrument, comprising:

a control processing unit which executes various program commands to independently and simultaneously control at least two tone sequences;

a timer;

a first program command set for mixing a first one of said at least two tone sequences with a second one of said at least two tone sequences;

a second program command set for synchronizing a first one of said at least two tone sequences with a second one of said at least two tone sequences;

a third program command set for independently and simultaneously controlling said at least two tone sequences;

a first set of operator controls selecting whether one or more of said first, second and third program command sets are executed by said central processing unit; and a communications bus operatively coupling signals with said central processing unit, said timer, and said first set of operator controls.

8. The electronic musical instrument of claim 7, further comprising non-volatile digital storage in which said tone sequences are stored.

9. The electronic musical instrument of claim 7, further comprising an external communications interface for exchanging tone sequence information with an external device.

10. A method for controlling a tone generator using at least two sequencers controlling various tone parameters simultaneously to process musical sequence information, comprising the steps of:

selecting sequence setting functions;

selecting sequence managing functions;

selecting sequence synchronization functions;

establishing a relationship between at least one of said various tone parameters of at least two of said at least two sequencers responsive to a combination of said sequence setting, managing and synchronization selections which, in a first combination is related and which in a second combination leaves said at least two of said at least two sequencers unrelated;

storing tone information responsive to said selected sequence setting, managing, and synchronization functions;

retrieving tone information responsive to said selected sequence setting, managing, and synchronization functions; and reproducing tone information responsive to said selected sequence setting, managing, and synchronization functions.

11. The method for controlling a tone generator of claim 10, wherein said selecting steps further comprise the selection of controls on a control panel by a human operator.

12. The method for controlling a tone generator of claim 10, wherein said step of retrieving tone information occurs simultaneous with said storing step.

13. The method for controlling a tone generator of claim 10, wherein said sequence setting, managing and synchronization selections in said first related tone parameter combination further comprises:

a first sub-combination in which said at least one of said various tone parameters is statically related;

a second sub-combination in which said at least one of said various tone parameters is dynamically related; and a third sub-combination in which said at least one of said various tone parameters is both statically and dynamically related.

14. The method for controlling a tone generator of claim 10, wherein said step of selecting sequence setting functions further comprises the steps of:

selecting at least one of said various tone parameters selected from the group of tempo, sequence to be performed, and pitch; and adjusting said selected at least one of said various tone parameters.

15. The method for controlling a tone generator of claim 10, wherein said step of selecting sequence managing functions comprises the steps of:

selecting at least one of said various sequence managing functions selected from the group of start, stop, position, forward, rewind, and pause; and adjusting said selected at least one of said various sequence managing functions.

16. The method for controlling a tone generator of claim 10, wherein said step of selecting sequence synchronization functions comprises the steps of:

selecting at least one of said varius tone parameters selected from the group of tempo lock synchronization, bar lock synchronization, delayed start synchronization, positioning start synchronization, simultaneous start synchronization, sequence to be performed, and pitch synchronization; and synchronizing said selected at least one parameter between said at least two of said at least two sequencers.

17. The method for controlling a tone generator of claim 10, wherein said step of selecting sequence synchronization functions comprises the steps of:

selecting tempo lock synchronization;

defining a tempo responsive to said tempo lock synchronization selecting step to which at least two of said at least two sequencers lock, said tempo selected from the group comprising a predetermined tempo, a tempo from an active sequencer, and a tempo from a latest started sequencer; and synchronizing said at least two of said at least two sequencers to said defined tempo.

18. The method for controlling a tone generator of claim 10, wherein said step of selecting sequence synchronization functions comprises the steps of:

selecting bar lock synchronization;

defining a first tempo responsive to said bar lock synchronization selecting step for a first one of said at least two sequencers and a second tempo for a second one of said at least two sequencers, said first tempo and said second tempo producing a same measure duration for both of said first and second ones of said at least two sequencers; and applying said first tempo to said first one of said at least two sequencers and said second tempo to said second one of said at least two sequencers.

19. The method for controlling a tone generator of claim 10, wherein said step of selecting sequence synchronization functions comprises the steps of:

selecting delayed start synchronization;

defining a first beat within a sequence of a first one of said at least two sequencers at which a sequence of a second one of said at least two sequencers will be started responsive to said delayed start synchronization selecting step; and starting said sequence of said second one of said at least two sequencers synchronized with said first beat.

20. The method for controlling a tone generator of claim 19, wherein said step of defining said first beat further comprises the steps of:

specifying a measure within said sequence of said first one of said at least two sequencers;

selecting a first occurring beat within said measure as said first beat.

21. The method for controlling a tone generator of claim 10, wherein said step of selecting sequence synchronization functions comprises the steps of:

selecting positioning start synchronization;

defining a current position of a first active one of said at least two sequencers;

identifying a corresponding position in terms of beat position in a corresponding measure in a second inactive one of said at least two sequencers responsive to said positioning start synchronization selecting step; and starting said second one of said at least two sequencers at said corresponding position.

22. The method for controlling a tone generator of claim 10, wherein said step of selecting sequence synchronization functions comprises the steps of:

selecting simultaneous start synchronization; and simultaneously starting at least two sequences within said at least two sequencers responsive to said simultaneous start synchronization selecting step.

* * * * *